US007417560B2

(12) United States Patent
Schwartz

(10) Patent No.: US 7,417,560 B2
(45) Date of Patent: Aug. 26, 2008

(54) MULTIMODE TRAFFIC PRIORITY/PREEMPTION INTERSECTION ARRANGEMENT

(75) Inventor: Mark A. Schwartz, River Falls, WI (US)

(73) Assignee: Global Traffic Technologies, LLC, Oakdale, MN (US)

( * ) Notice: Subject to any disclaimer, the term of this patent is extended or adjusted under 35 U.S.C. 154(b) by 75 days.

(21) Appl. No.: 11/142,026

(22) Filed: Jun. 1, 2005

(65) Prior Publication Data

US 2006/0273923 A1 Dec. 7, 2006

(51) Int. Cl.
*G08G 1/07* (2006.01)

(52) U.S. Cl. ..... 340/906

(58) Field of Classification Search ..... 340/906, 340/907, 988, 910, 916, 917; 359/142; 701/117; 455/32.1

See application file for complete search history.

(56) References Cited

U.S. PATENT DOCUMENTS

| | | | |
|---|---|---|---|
| 3,550,078 | A | 12/1970 | Long |
| 3,831,039 | A | 8/1974 | Henschel |
| 4,162,447 | A | 7/1979 | Teshirogi et al. |
| 4,162,477 | A | 7/1979 | Munkberg |
| 4,228,419 | A | 10/1980 | Anderson |
| 4,230,992 | A | 10/1980 | Munkberg |
| 4,234,967 | A | 11/1980 | Henschel |
| 4,463,339 | A | 7/1984 | Frick et al. |
| 4,680,811 | A | 7/1987 | Harper et al. |
| 4,704,610 | A | 11/1987 | Smith et al. |
| 4,717,913 | A | 1/1988 | Elger |
| 4,727,600 | A | 2/1988 | Avakian |
| 4,734,881 | A | 3/1988 | Klein et al. |
| 4,914,434 | A | 4/1990 | Morgan et al. |
| 4,970,439 | A | 11/1990 | Stopa |

(Continued)

FOREIGN PATENT DOCUMENTS

| | | | |
|---|---|---|---|
| WO | WO-2006130357 | A3 | 12/2003 |

(Continued)

OTHER PUBLICATIONS

"Strobecom II, Optical Preemption and Priority Control System", http://www.tomar.com/strobecom/index.htm, 3, pages. Printed from Internet Feb. 8, 2005.

(Continued)

*Primary Examiner*—Davetta W. Goins
*Assistant Examiner*—Sigmund Tang
(74) *Attorney, Agent, or Firm*—Schwegman, Lundberg & Woessner, P.A.

(57) ABSTRACT

A traffic light control system includes at least one parameter and a signal decoding circuit. The parameter or parameters are useful for assisting in differentiating between multiple communication modes. The signal decoding circuit has a front-end circuit and a back-end circuit. The front-end circuit is adapted to receive respective signals transmitted in multiple communication modes. The front-end circuit is adapted to produce data representative of at least a portion of the respective signals. The back-end circuit is adapted to interpret and process the produced data according to at least one of multiple traffic light control protocols respectively associated with the multiple communication modes. The signal decoding circuit is adapted to access said at least one parameter and associate the produced data with one of the multiple communication modes.

11 Claims, 4 Drawing Sheets

U.S. PATENT DOCUMENTS

| | | | | |
|---|---|---|---|---|
| 4,972,185 | A | | 11/1990 | Stopa et al. |
| 4,992,790 | A | | 2/1991 | Montgomery |
| 5,014,052 | A | | 5/1991 | Obeck |
| 5,159,480 | A | | 10/1992 | Gordon et al. |
| 5,172,113 | A | * | 12/1992 | Hamer ..... 340/907 |
| 5,187,373 | A | | 2/1993 | Gregori |
| 5,187,476 | A | | 2/1993 | Hamer |
| 5,202,683 | A | | 4/1993 | Hamer et al. |
| 5,519,389 | A | | 5/1996 | DeGunther et al. |
| 5,539,398 | A | | 7/1996 | Hall et al. |
| 5,602,739 | A | | 2/1997 | Haagenstad et al. |
| 5,926,113 | A | | 7/1999 | Jones et al. |
| 5,986,575 | A | | 11/1999 | Jones et al. |
| 6,243,026 | B1 | | 6/2001 | Jones et al. |
| 6,281,808 | B1 | | 8/2001 | Glier et al. |
| 6,429,812 | B1 | | 8/2002 | Hoffberg |
| 6,621,420 | B1 | | 9/2003 | Poursartip |
| 7,116,245 | B1 | | 10/2006 | Bachelder |

FOREIGN PATENT DOCUMENTS

| | | | |
|---|---|---|---|
| WO | WO-2006130634 | A2 | 12/2003 |

OTHER PUBLICATIONS

Tomar Electronics, "Strobecom II", System Manual (Rev 3), Jun. 2000, 25 pages. Jun. 2000.

Tomar Electronics, "Strobecom II. Optical Signal Processor Configuration Software (OSPsoft)," User's Manual, Version 2.0 for use with OSP Version 2.0, May 2000, 40 pages. May 2000.

"Elock™ Emitter Authenticator," http://www.tomar.com/products/elock/elock.htm, 11 pages. Printed from Internet Apr. 27, 2005.

"U.S. Appl. No. 11/142,021, filed Nov. 21, 2007 to Final Office Action mailed Aug. 23, 2007", 7 pgs.

"U.S. Appl. No. 11/142,021, Final Office Action mailed Aug. 23, 2007", 5 pgs.

"U.S. Appl. No. 11/142,021, Non-Final Office Action mailed Jan. 10, 2007", 6 pgs.

"U.S. Appl. No. 11/142,021, filed Jun. 8, 2007 to Non-Final Office Action mailed Jan. 10, 2007", 7 pgs.

"International Search Report for PCT/US/2006/19379 mailed Jul. 26, 2007", 3 pages.

"Written Opinion for PCT/US2006/19379 mailed Jul. 26, 2007",6 pages.

"U.S. Appl. No. 11/142,021, Non-Final Office Action Mailed Jan. 9, 2008", 7.

* cited by examiner

MULTIMODE TRAFFIC PRIORITY/PREEMPTION INTERSECTION ARRANGEMENT

FIELD OF THE INVENTION

The present invention is generally directed to systems and methods that allow traffic light systems to be remotely controlled using data communication, for example, involving optical pulse transmission from an optical emitter to an optical detector that is communicatively-coupled to a traffic light controller at an intersection.

BACKGROUND OF THE INVENTION

Traffic signals have long been used to regulate the flow of traffic at intersections. Generally, traffic signals have relied on timers or vehicle sensors to determine when to change the phase of traffic signal lights, thereby signaling alternating directions of traffic to stop, and others to proceed.

Emergency vehicles, such as police cars, fire trucks and ambulances, are generally permitted to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

There are presently a number of optical traffic priority systems that permit emergency vehicles to preempt the normal operation of the traffic signals at an intersection in the path of the vehicle to permit expedited passage of the vehicle through the intersection. These optical traffic priority systems permit a code to be embedded into an optical communication to identify each vehicle and provide security. Such a code can be compared to a list of authorized codes at the intersection to restrict access by unauthorized users. However, the various optical traffic priority systems are incompatible because the vehicle identification code for each of the various optical traffic priority systems is embedded in the optical communication using incompatible modulation schemes.

Generally, an optical traffic priority system using a particular modulation scheme is independently purchased and implemented in each jurisdiction, such as a city. Thus, the traffic lights and the emergency vehicles for the jurisdiction are equipped to use the particular modulation scheme. However, a neighboring jurisdiction may use equipment that embeds the vehicle identification code using an incompatible modulation scheme. Frequently, a pursuit by a police car or the route of an ambulance may cross several jurisdictions each using an incompatible modulation scheme to embed the vehicle identification information. It may be burdensome and expensive to allow a vehicle from a neighboring jurisdiction to preempt traffic lights while maintaining appropriate security to prevent unauthorized preemption of traffic lights.

SUMMARY OF THE INVENTION

The present invention is directed to overcoming the above-mentioned challenges and others that are related to the types of approaches and implementations discussed above and in other applications. The present invention is exemplified in a number of implementations and applications, some of which are summarized below.

In connection with one embodiment, the present invention is directed to implementations that allow traffic light systems to be remotely controlled using multiple communication modes.

In a more particular embodiment, a traffic light control system includes at least one parameter and a signal decoding circuit. The parameter or parameters are useful for assisting in differentiating between multiple communication modes. The signal decoding circuit has a front-end circuit and a back-end circuit. The front-end circuit is adapted to receive respective signals transmitted in multiple communication modes. The front-end circuit is adapted to produce data representative of at least a portion of the respective signals. The back-end circuit is adapted to interpret and process the produced data according to at least one of multiple traffic light control protocols respectively associated with the multiple communication modes. The signal decoding circuit is adapted to access the at least one parameter and associate the produced data with one of the multiple communication modes.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the detailed description of various embodiments of the invention in connection with the accompanying drawings, in which.

Figure 1:
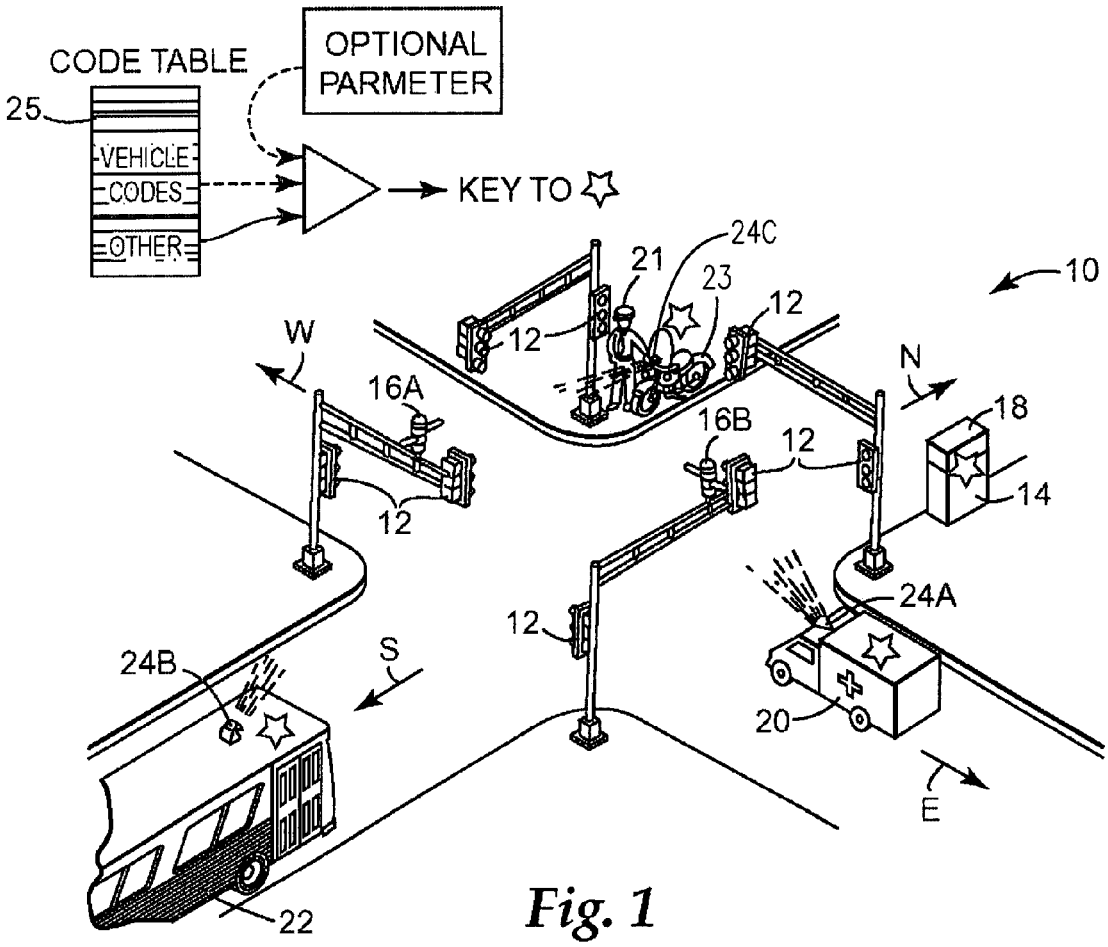
FIG. 1 is a perspective view of a bus and an ambulance approaching a typical traffic intersection, with emitters mounted to the bus and the ambulance each transmitting an optical signal using respective incompatible communication modes in accordance with the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF THE EMBODIMENTS

The present invention is believed to be applicable to a variety of different communication modes in an optical traffic preemption system. While the present invention is not necessarily limited to such approaches, various aspects of the invention may be appreciated through a discussion of various examples using these and other contexts.

The optical traffic preemption system shown in FIG. 1 is presented at a general level to show the basic circuitry used to implement example embodiments of the present invention. In this context, FIG. 1 illustrates a typical intersection 10 having traffic signal lights 12. A traffic signal controller 14 sequences the traffic signal lights 12 through a sequence of phases that allow traffic to proceed alternately through the intersection 10. The intersection 10 is equipped with an optical traffic preemption system having certain aspects and features enabled in accordance with the present invention to support multiple communication modes in an efficient, flexible and practicable manner.

This support for multiple communication modes is provided in the optical traffic preemption system of FIG. 1 by way of optical emitters 24A, 24B and 24C, detector assemblies 16A and 16B, and a phase selector 18. The detector assemblies 16A and 16B are stationed to detect light pulses from optical emitters 24A, 24B and 24C mounted on authorized vehicles approaching the intersection 10. The detector assemblies 16A and 16B communicate with the phase selector 18, which is typically located in the same cabinet as the traffic controller 14.

In FIG. 1, an ambulance 20 and a bus 22 are approaching the intersection 10. The optical emitter 24A is mounted on the ambulance 20 and the optical emitter 24B is mounted on the bus 22. The optical emitters 24A and 24B each transmit a stream of light pulses. The stream of light pulses can transport data values that identify a requested operation, such as preemption of the normal operation of the traffic lights 12 to allow expedited passage of the vehicle 20 or 22 through the intersection 10. The detector assemblies 16A and 16B receive these light pulses and send an output signal to the phase selector 18. The phase selector 18 processes and validates the output signal from the detector assemblies 16A and 16B.

The optical emitters 24A and 24B can use incompatible communication modes and modulation schemes to embed the data values in the stream of light pulses. Various embodiments of the invention provide extraction and validation of the data values embedded in the stream of light pulses by the detector assemblies 16A and 16B and the phase selector 18, regardless of the communication mode used by a particular emitter 24A or 24B. After extraction and successful validation of a requested operation, the phase selector 18 can issue a phase request to the traffic signal controller 14 to preempt the normal operation of the traffic signal lights 12.

FIG. 1 also shows an authorized person 21 operating a portable optical emitter 24C, which is there shown mounted to a motorcycle 23. In one embodiment, the emitter 24C is used to configure parameters of the detector assemblies 16A and 16B and/or phase selector 18, including parameters used to differentiate the various communication modes and to validate data values embedded in the stream of light pulses according to multiple traffic light control protocols respectively associated with the multiple communication modes. In another embodiment, the emitter 24C is used by the authorized person 21 to affect the traffic signal lights 12 in situations that require manual control of the intersection 10.

Typically, the data values for a requested operation include a vehicle identification code. Phase selectors constructed in accordance with the present invention can be configured to use a vehicle identification code in various ways. In one configuration, the phase selector 18 is configured with parameters providing a list of authorized identification codes. In this configuration, the phase selector 18 confirms that the vehicle is indeed authorized to preempt the normal traffic signal sequence. If the received vehicle identification code does not match one of the authorized identification codes on the list, preemption does not occur. In another configuration, the phase selector 18 is configured with parameters specifying limits for a range of values of authorized identification codes, possibly with separate ranges for emergency vehicles 20 and mass transit vehicles 22. If the received vehicle identification code is not within the appropriate range of values, preemption does not occur.

In yet another configuration, the phase selector 18 logs all preemption requests by recording the time of preemption, direction of preemption, duration of preemption, identification code, confirmation of passage of a requesting vehicle within a predetermined range of a detector, and denial of a preemption request due to improper authorization. In this configuration, attempted abuse of an optical traffic preemption system can be discovered by examining the logged information.

In another embodiment of the present invention, an optical traffic preemption system helps run a mass transit system more efficiently. An authorized mass transit vehicle having an optical emitter constructed in accordance with the present invention, such as the bus 22 in FIG. 1, spends less time waiting at traffic signals, thereby saving fuel and allowing the mass transit vehicle to serve a larger route. This also encourages people to utilize mass transportation instead of private automobiles because authorized mass transit vehicles move through congested urban areas faster than other vehicles.

Unlike an emergency vehicle, a mass transit vehicle equipped with an optical emitter may not require total preemption. In one embodiment, a traffic signal offset is used to give preference to a mass transit vehicle, while still allowing all approaches to the intersection to be serviced. For example, a traffic signal controller that normally allows traffic to flow 50 percent of the time in each direction responds to repeated phase requests from the phase selector to allow traffic flowing in the direction of the mass transit vehicle to proceed 65 percent of the time and traffic flowing in the other direction to flow 35 percent of the time. In this embodiment, the actual offset is fixed to allow the mass transit vehicle to have a predictable advantage. Generally, proper authorization should be validated before executing an offset for a mass transit vehicle.

In a typical installation, the traffic preemption system does not actually control the lights at a traffic intersection. Rather, the phase selector 18 alternately issues phase requests to and withdraws phase requests from the traffic signal controller 14, and the traffic signal controller determines whether the phase requests can be granted. The traffic signal controller may also receive phase requests originating from other sources, such as a nearby railroad crossing, in which case the traffic signal controller may determine that the phase request from the other source be granted before the phase request from the phase selector. However, as a practical matter, the preemption system can affect a traffic intersection and create a traffic signal offset by monitoring the traffic signal controller sequence and repeatedly issuing phase requests that will most likely be granted.

According to a specific example embodiment, the traffic preemption system of FIG. 1 is implemented using a known implementation that is modified to support multiple communication modes. For example, an Opticom™ Priority Control System (manufactured by 3M Company of Saint Paul, Minn.) can be modified to support one or more communication modes in addition to the communication mode for the Opticom™ Priority Control System. Consistent with features of the Opticom™ Priority Control System, one or more embodiments of U.S. Pat. No. 5,172,113 can be modified in this manner. Also according to the present invention, another specific example embodiment is implemented using another commercially-available traffic preemption system, such as the Strobecom II system (manufactured by TOMAR Electronics, Inc. of Phoenix, Ariz.), modified to support one or more additional communication modes.

Figure 2A:
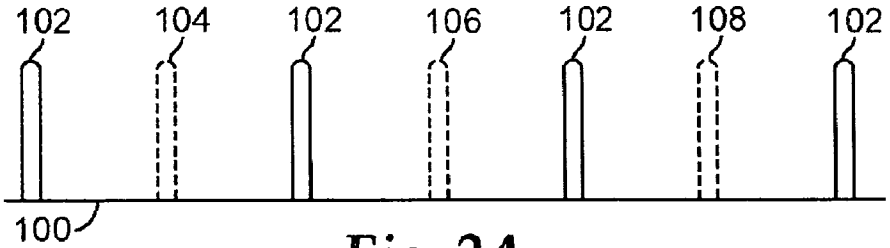
FIGS. 2A, 2B and 2C illustrate optical pulses transmitted between a vehicle and equipment at an intersection for various example communication modes in accordance with the present invention.
Figure 2B:
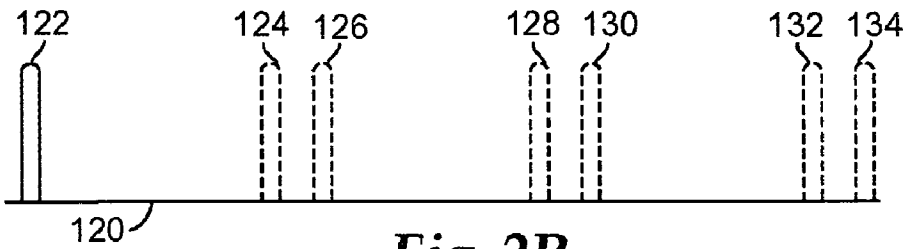
Figure 2C:
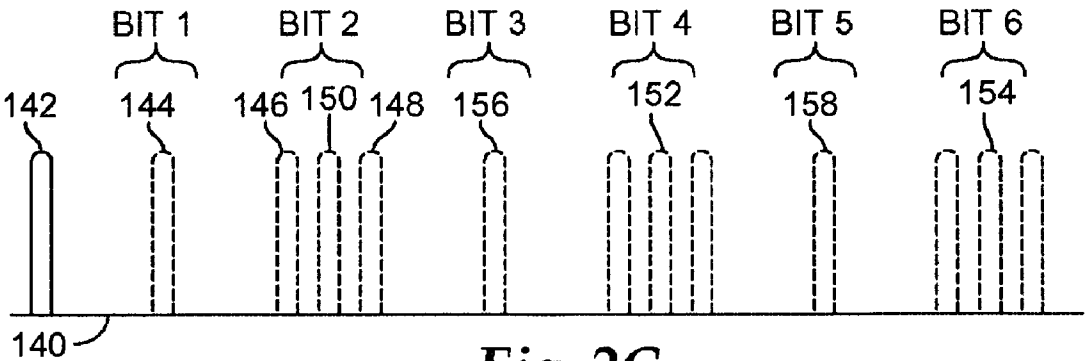

FIG. 2A-2C illustrate optical pulses transmitted between a vehicle and equipment at an intersection for various example communication modes in accordance with the present invention. A first communication mode as illustrated in FIG. 2A, can have optical pulse stream 100. A second communication, as illustrated in FIG. 2B, mode can have optical pulse stream 120. A third communication mode, as illustrated in FIG. 2C, can have optical pulse stream 140 that combines the features of optical pulse streams 100 and 120.

Optical pulse stream 100 has major stroboscopic pulses of light 102 occurring at a particular frequency that typically is nominally either 10 Hz or 14 Hz. Between the major pulses, optional data pulses 104, 106, and 108 carry the data values embedded in the optical pulse stream 100. For example, if pulse 104 is present then a data value has a first bit of one, and if pulse 104 is absent then the data value has a first bit of zero. If pulse 106 is present then the data value has a second bit of one, and if pulse 106 is absent then the data value has a second bit of zero. Similarly, if pulse 108 is present then the data value has a third bit of one, and if pulse 108 is absent then the data value has a third bit of zero. Typically, the optional pulses 104, 106, and 108 are half-way between the major pulses 102. Optical pulse stream 100 may correspond to the communication mode of an Opticom™ Priority Control System.

Optical pulse stream 120 has stroboscopic pulses of light that nominally occur at a particular frequency that typically is approximately either 10 Hz or 14 Hz, but the pulses are displaced from the nominal frequency to embed the data values in the optical pulse stream 120. For example, after an initial pulse 122, only one or the other of pulses 124 and 126 is present and if an early pulse 124 is present then a data value has a first bit of zero and if late pulse 126 is present then the data value has a first bit of one. Only one or the other of pulses 128 and 130 is present and if early pulse 128 is present then the data value has a second bit of zero and if late pulse 130 is present then the data value has a second bit of one. Similarly, only one or the other of pulses 132 and 134 is present and if early pulse 132 is present then the data value has a third bit of zero and if late pulse 134 is present then the data value has a third bit of one.

Another optical pulse stream is similar to optical pulse stream 120 in having stroboscopic pulses of light that nominally occur at a particular frequency that typically is approximately either 10 Hz or 14 Hz, with the pulses displaced from the nominal frequency to embed the data values in the optical pulse stream 120. However, each pulse is separated from the prior pulse with a nominal time period corresponding to the nominal frequency with the actual separation between a pulse and the prior pulse being slightly less or slightly more than the nominal time period. An early pulse with a separation from the prior pulse of slightly less than the nominal time period embeds a data bit of zero and a late pulse with a separation from the prior pulse of slightly more than the nominal time period embeds a data bit of one. Such an optical pulse stream may correspond to the communication mode of a Strobecom II system.

Optical pulse stream 140 combines the possible pulse positions of optical pulse streams 100 and 120, providing the benefit that more data values can be embedded in the pulse stream in a given time period. The additional data can be used to provide additional operations, to enhance the security using encryption, and/or enhance robustness by adding error detection or correction without increasing the response time of the optical traffic control system. After the initial pulse 142, the presence or absence of pulse 144 respectively provides a first bit of one or zero. Only one of pulses 146, 150, and 148 is present in pulse stream 140. The presence of pulse 146 provides a second bit of zero and the presence of pulse 148 provides a second bit of one. The presence of pulse 150 could indicate that the second bit does not have a value or the second bit has an unknown value. Additional bits including a third bit through the sixth bit are similarly embedded.

It will be appreciated that an optical pulse stream similar to stream 140 can combine the possible pulse positions of pulse stream 100 and a second optical pulse stream that embeds data values by shifting the time period between each pulse and the prior pulse slightly from the nominal time period. Such a combined pulse stream can position the intermediate pulses 104, 106, and 108 of stream 100 halfway between the slightly shifted pulses that are substituted for pulses 102 of stream 100.

A detection circuit arranged to extract the embedded data values for optical pulse stream 140 has the advantage of supporting a higher data communication rate and being compatible with both optical pulse streams 100 and 120. After receiving an optical pulse stream 140 and extracting the embedded data value, a data value with any of the second, fourth, and sixth bits having an unknown value, as indicated by the presence of a pulse 150, 152, or 154, corresponds to optical pulse stream 100. None of the second, fourth, and sixth bits having an unknown value, as indicated by the absence of pulses 150, 152, and 154, and any of the first, third, and fifth bit having a value of a one, as indicated by the presence of a pulse 144, 156, or 158, corresponds to pulse stream 140. None of the second, fourth, and sixth bits having an unknown value and none of the first, third, and fifth bits having a value of a one, as indicated by the absence of pulses 144, 156, and 158, can correspond to pulse stream 120. Thus, not only can the embedded data be extracted for either of optical pulse streams 100 and 120 by a detection circuit supporting optical pulse stream 140, in addition the pulse streams 100, 120, and 140 can be readily distinguished.

The nominal frequency used to transmit pulses of an optical pulse stream 100, 120, and 140 can determine a priority. For example, a frequency of approximately 10 Hz can correspond to a high priority for an emergency vehicle and a frequency of approximately 14 Hz can correspond to a low priority for a mass transit vehicle.

Figure 3:
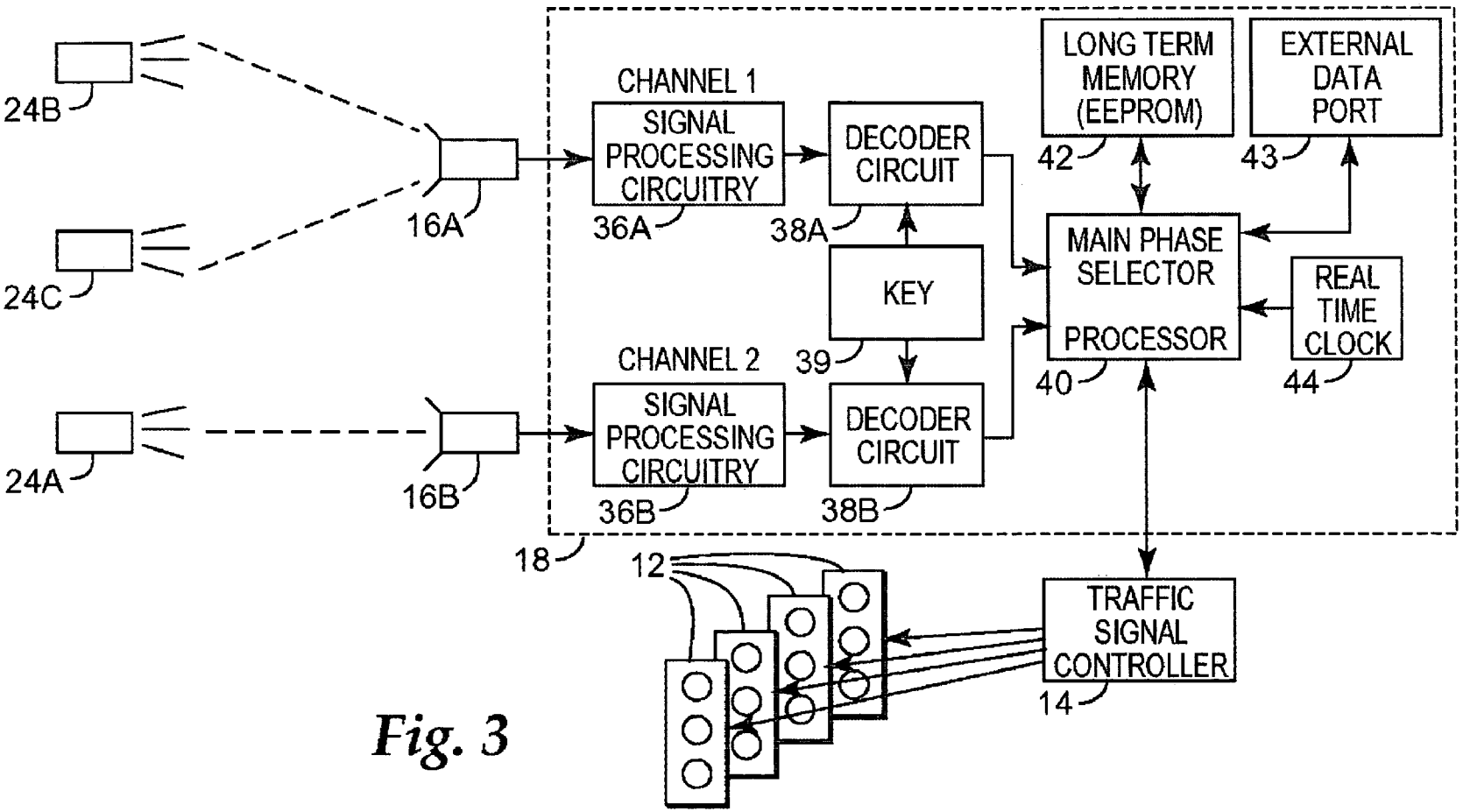
FIG. 3 is a block diagram of the components of an optical traffic preemption system for an embodiment in accordance with the present invention.

FIG. 3 is a block diagram showing the optical traffic preemption system of FIG. 1. In FIG. 3, light pulses originating from the optical emitters 24A and 24B are received by the detector assembly 16B, which is connected to a channel one and channel two of the phase selector 18. The main processor 40 of phase selector 18 communicates with the traffic signal controller 14, which in turn controls the traffic signal lights 12.

In one embodiment, detector assembly 16B is a front-end circuit receiving signals from emitters 24A and 24B having respective communication modes. Signal processing circuitry 36A and 36B and processors 38A, 38B, and 40 are a back-end circuit that interprets and processes data produced by the detector assembly 16B from the received signals. Channel one signal processing circuitry 36A and processor 38A can interpret and process the data according to a traffic light control protocol corresponding to the communication mode of emitter 24A and channel two signal processing circuitry 36B and processor 38B can interpret and process the data according to a traffic light control protocol corresponding to the communication mode of emitter 24B. It will be appreciated that protocols for multiple communication modes may be interpreted and processed in various embodiments with a single signal processing channel as is discussed in connection with FIG. 4. Circuits 16B, 36A, 36B, 38A, 38B, and 40 may operate using parameters stored internally to the respective circuit or stored in long term memory 42 and some of these parameters can be useful for differentiating between the communication modes of emitters 24A and 24B by the respective channel.

In another embodiment, detector assembly 16B and signal processing circuitry 36A and 36B are a front-end circuit receiving signals from emitters 24A and 24B having respective communication modes. Processors 38A, 38B, and 40 are a back-end circuit that interprets and process data from the signal processing circuitry 36A and 36B. Processor 38A can interpret and process the data according to a traffic light control protocol corresponding to the communication mode of emitter 24A and processor 38B can interpret and process the data according to a traffic light control protocol corresponding to the communication mode of emitter 24B. Circuits 16B, 36A, 36B, 38A, 38B, and 40 may operate using parameters stored internally to the respective circuit or stored in long term memory 42 and some of these parameters can be useful for differentiating between the communication modes of emitters 24A and 24B by the processors 38A, 38B, and 40.

The phase selector 18 includes the two channels, with each channel having signal processing circuitry (36A and 36B) and a processor (38A and 38B), a main processor 40, long term memory 42, an external data port 43 and a real time clock 44. With reference to the channel one, the signal processing circuitry 36A receives an analog signal provided by the detector assembly 16B. The signal processing circuitry 36A processes the analog signal and produces digital data that is received by the channel processor 38A. The channel processor 38A extracts the embedded data value from the digital data and provides the data value to the main processor 40. Channel two is similarly configured, with the detector assembly 16B coupled to the signal processing circuitry 36B, which in turn is coupled to the channel processor 38B. Each channel is dedicated to interpreting and processing data according to a respective traffic signal control protocol. It will be appreciated that channel two may process the received signal either in parallel with channel one or after channel one has determined that the received signal is not recognized as corresponding to the communication mode of channel one.

The long term memory 42 is implemented using electronically erasable programmable read only memory (EEPROM). The long term memory 42 is coupled to the main processor 40 and is used log data and to store configuration parameters and a list of authorized identification codes. The main processor 40 checks for proper authorization by checking that the received vehicle identification code matches an entry in a list authorized identification.

The external data port 43 is used for coupling the phase selector 18 to a computer. In one embodiment, external data port 43 is an RS232 serial port. Typically, portable computers are used in the field for exchanging data with and configuring a phase selector with parameters. Logged data is removed from the phase selector 18 via the external data port 43 and parameters and a list of authorized identification codes are stored in the phase selector 18 via the external data port 43. The external data port 43 can also be accessed remotely using a modem, local-area network or other such device.

The real time clock 44 provides the main processor 40 with the actual time. The real time clock 44 provides time stamps that can be logged to the long term memory 42 and is used for timing other events, such as providing a time tag associated with each light pulse received at detector assembly 16B.

Figure 4:
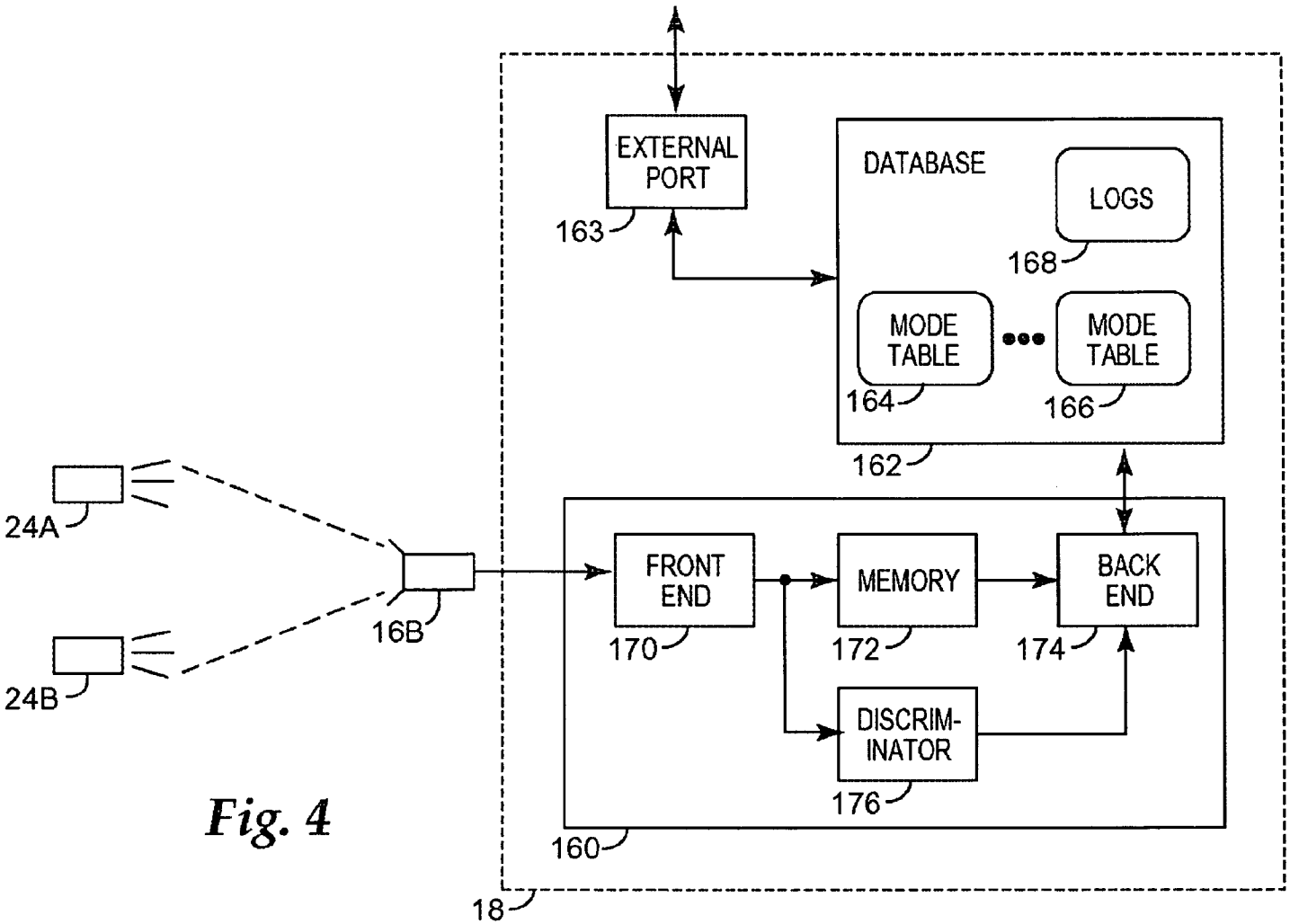
FIG. 4 is a block diagram of the components of an optical traffic preemption system for another embodiment in accordance with the present invention.

FIG. 4 is a block diagram of the components of an optical traffic preemption system for another embodiment in accordance with the present invention. Light pulses originating from the optical emitters 24A and 24B are received by the detector assembly 16B, which is connected to phase selector 18. Phase selector 18 supports multiple communication modes having corresponding traffic light control protocols. For example, optical emitter 24A can use one communication mode, optical emitter 24B can use another communication mode, and phase selector 18 can support both emitters 24A and 24B including extracting data values embedded in the optical pulse streams received from emitters 24A and 24B. Phase selector 18 includes a decoder 160, a database 162 and an external port 163.

Database 162 includes parameters to configure the operation of the decoder 160 including a single table 164 in one embodiment and multiple tables 164 and 166 in another embodiment. A single table 164 can include information for multiple communication modes. For example, even though different modulation schemes are used to embed a vehicle identification code for two communication modes, a single set of identification codes for both communication modes can be maintained in the table 164. For another example, table 164 can include identification codes for one communication mode and table 166 can include identification codes for another communication mode.

Database 162 can also include logs 168 of preemption activity. For example, each successful and unsuccessful preemption request received can be logged in logs 168, including the vehicle identification code for the preemption request and the communication mode used to make the preemption request. An external port 163 provides access to the database 162 including downloading and erasing the logs 168 and updating the mode tables 164 and 166.

Front-end circuit 170 can include a sampling analog to digital converter (ADC) and a digital signal processor (DSP). The ADC may have configurable parameters, such as sampling rate, and the DSP can have configurable parameters, such as filter software routines, that are provided by database 162. Serially produced data from front-end circuit 170 can be stored in memory 172. Memory 172 can temporarily store the serial data stream until one or more complete operation requests are available for processing by back-end circuit 174 and until the discriminator 176 determines the communication mode being used using various distinguishing characteristics of the communication modes. Using the communication mode from discriminator 176, the back-end circuit 174 extracts the data values embedded in the optical pulse stream. The back-end circuit 174 validates the operation request in the data values according to the traffic light control protocol corresponding to the communication mode.

What is claimed is:

1. A traffic light control system for placement in the vicinity of one or more traffic lights, comprising:

at least one parameter useful for assisting in differentiating between multiple communication modes using incompatible modulation schemes;

a signal decoding circuit having a front-end circuit adapted to receive respective signals transmitted in multiple communication modes and produce data representative of at least a portion of the respective signals, and a back-end circuit adapted to interpret and process the produced data according to at least one of multiple traffic light control protocols respectively associated with the multiple communication modes; and wherein the signal decoding circuit is adapted to access said at least one parameter and associate the produced data with one of the multiple communication modes.

2. The traffic light control system of claim 1, wherein the signal decoding circuit is adapted to access and use said at least one parameter before the back-end circuit interprets and processes the produced data.

3. The traffic light control system of claim 1, wherein the back-end circuit is adapted to use said at least one parameter for interpreting and processing the produced data.

4. The traffic light control system of claim 1, wherein the signal decoding circuit is adapted to channel the produced data through a first one of two mode decoding modules, before the other of the two mode decoding modules, to facilitate interpreting the produced data, wherein the two mode decoding modules respectively correspond to two of the multiple communication modes.

5. The traffic light control system of claim 1, wherein the signal decoding circuit includes a circuit adapted to differentiate between the multiple communication modes using said at least one parameter.

6. The traffic light control system of claim 1, wherein the back-end circuit is adapted to log a portion of the produced data and thereby provide access thereto for external display.

7. The traffic light control system of claim 1, wherein the back-end circuit is adapted to validate the produced data according to said at least one of the multiple traffic light control protocols.

8. The traffic light control system of claim 7, wherein said at least one parameter includes multiple tables respectively associated with the multiple communication modes and the back-end circuit is adapted to validate the produced data using one of the multiple tables.

9. The traffic light control system of claim 7, wherein said at least one parameter includes a table containing information associated with each of the multiple communication modes and the back-end circuit validates the produced data using the table.

10. The traffic light control system of claim 1, wherein the back-end circuit includes a processor that accesses a database including said at least one parameter.

11. The traffic light control system of claim 1, wherein said at least one parameter includes at least one table that includes vehicle identification codes for the multiple traffic light control protocols.

* * * * *